United States Patent [19]

Adams et al.

[11] Patent Number: 4,637,312

[45] Date of Patent: Jan. 20, 1987

[54] EXPLOSIVE PRIMER AND CARRIER THEREFOR

[75] Inventors: Philip E. Adams; Michael J. McGowan, both of Martinsburg, W. Va.; Malak E. Yunan, Boonton Township, Morris County, N.J.

[73] Assignee: E. I. Du Pont de Nemours and Company, Wilmington, Del.

[21] Appl. No.: 729,480

[22] Filed: May 1, 1985

[51] Int. Cl.[4] ..... F42B 3/10; C06C 5/04

[52] U.S. Cl. ..... 102/275.12; 102/275.3; 102/275.4; 102/275.5

[58] Field of Search ..... 102/275.12, 275.4, 275.5, 102/275.6, 275.7, 275.1, 275.11, 275.3, 313

[56] References Cited

U.S. PATENT DOCUMENTS

| | | | |
|---|---|---|---|
| Re. 30,621 | 5/1981 | Calder et al. | 102/275.7 X |
| 4,060,034 | 11/1977 | Bowman et al. | 102/275.5 |
| 4,165,691 | 8/1979 | Bowman et al. | 102/275.7 X |
| 4,295,424 | 10/1981 | Smith et al. | 102/275.4 X |
| 4,334,476 | 6/1982 | Day et al. | 102/275.7 |
| 4,383,484 | 5/1983 | Morrey | 102/275.8 X |
| 4,485,741 | 12/1984 | Moore et al. | 102/331 |
| 4,527,482 | 7/1985 | Hynes | 102/275.5 X |

*Primary Examiner*—David H. Brown

[57] ABSTRACT

A carrier for supporting a primer explosive charge in operative relationship to initiating means therefor comprises a cup having a recessed portion in its closed bottom end for engaging an explosive-containing plastic connecting block, used to explosively couple a low-energy detonating cord (LEDC), threaded through a tunnel in the cup, to a percussion-actuated detonator seated in a cavity (cap well) in the cup. A number of such primers can be made to slide on a single LEDC downline for placement in decked explosive charges in a borehole. Two tubular members project into the cup from the recessed portion, forming one or two cord-threading tunnels and a cap well. Besides initiation of a detonator by an LEDC downline via the explosive coupler, the carrier allows the primer charge to be initiated by a high-energy detonating cord or an electric detonator in an axial tunnel in the cup, or by a length of LEDC threaded through a tunnel and connected to a non-electric detonator seated in the cap well.

14 Claims, 11 Drawing Figures

EXPLOSIVE PRIMER AND CARRIER THEREFOR

BACKGROUND OF THE INVENTION

1. Field of the Invention

The present invention relates to an explosive primer, and to a carrier for supporting the primer explosive charge therein in operative relationship to initiating means for the charge. More particularly, the invention relates to a carrier adapted, in one embodiment, to support a primer explosive charge, a percussion-actuated detonator operatively connected thereto, and an explosive coupler adapted to transmit an initiating impulse to said detonator from a low-energy detonating cord.

2. Description of the Prior Art

High-energy primers (sometimes referred to as "boosters") are used to initiate relatively insensitive explosives and blasting agents such as ANFO (ammonium nitrate—fuel oil) products and certain water gels. The primers, in turn, may be initiated by an instantaneous or delay electric detonator, a 3.8–13 g/m detonating cord downline, or a non-electric delay detonator actuated by a low-energy detonating cord (LEDC) downline. In the deck-loading technique of delay blasting with a cap-insensitive explosive loaded into the borehole in decks separated from one another by a layer of inert stemming material, each deck may require a delay primer (e.g., a primer operatively connected to a delay detonator), in which a delay detonator is operatively connected to a downline cord. Systems in which the delay primers in all of the decks are connected by a single downline are preferred because the downline system is less complex and the borehole loading operation and hookup easier.

U.S. Pat. No. 4,295,424, issued to D. H. Smith et al., and Atlas Data Sheet 701: *Deckmaster/Primemaster*, Atlas Powder Company, Dallas, Tex., describe an open-ended container for a cast primer having a tubular conduit disposed longitudinally on its exterior for threading a 4–6 g/m downline detonating cord, multiple primer units being threadable on a single downline. The container has a transverse partition separating the cast primer charge in a bottom section from an upper section which houses an elongated L-shaped insert consisting of a flexible curved tube with a sensor on one end and a delay detonator on the other. The partition has an aperture to allow the detonator portion of the insert to be positioned in the primer charge on the side opposite the tubular conduit.

A delay booster container shown in U.S. Pat. No. Re. 30,621 and Austin Technical Data Bulletin ADP 1183, Austin Powder Company, Cleveland, Ohio, entitled *Austin Delay Boosters* is a cup having an axial aperture in its closed bottom end and an external downline channel. An elongated delay element, in the form of a delay detonator having the end of a pigtail cord crimped into its shell is used. The detonator portion of the delay element is inserted into a delay channel formed by a center bore in the cast primer charge, through the aperture in the bottom of the cup. The external downline channel receives the pigtail, which side-abuts a downline threaded through multiple boosters.

SUMMARY OF THE INVENTION

The present invention provides a carrier for supporting a primer explosive charge in operative relationship to initiating means therefor, which carrier comprises a cup having (a) a closed bottom end provided with a recessed portion;

(b) first and second tubular members projecting into the cup from the recessed portion on axes substantially parallel to the cup's longitudinal axis, (1) the first tubular member having an open top end located in the vicinity of the cup's open top end and an open bore which extends from the first tubular member's top end and terminates at the bottom end of the cup in the recessed portion so as to form an opening therein and a first threading tunnel in the cup, and (2) the second tubular member having (A) a closed end located inside the cup and a bore which extends from the closed end and terminates at the bottom end of the cup in the recessed portion so as to form an opening therein and a detonator-positioning cavity (i.e., a cap well) in the cup, or (B) an open top end located in the vicinity of the cup's open top end and an open bore which extends from the second tubular member's open top end and terminates at the bottom end of the cup in the recessed portion so as to form an opening therein and a second threading tunnel or a detonator-positioning cavity in the cup; and (c) means, e.g., one or more grooved or ribbed surfaces, in the recessed portion of the cup for engaging an explosive-containing plastic connecting block for explosively coupling a low-energy detonating cord adapted to be threaded through the first threading tunnel to a detonator adapted to be placed in the detonator-positioning cavity.

In one embodiment, the second tubular member is closed at one end, thereby forming a cavity or blind hole for seating a detonator, and the first tubular member, which forms a cord-threading tunnel, lies essentially on the cup's longitudinal axis. This particular carrier is adapted to be used in a primer which can be initiated by an electric detonator seated in the second tubular member, with its leg wires threaded through the axial tunnel, or by a non-electric detonator (seated in the second tubular member) actuated directly or indirectly by a low-energy detonating cord (LEDC) threaded through the axial tunnel. When multiple primers are threaded on a single downline LEDC, as is used in the initiation of deck-loaded explosive charges, a non-electric detonator in the second tubular member can be initiated by the LEDC (threaded through the axial tunnel) via an explosive coupling element located in the recessed portion at the bottom end of the cup, as will be described more fully hereinafter. This primer also can be initiated directly by a detonating cord threaded through the axial tunnel.

In an alternative embodiment, the second tubular member, like the first, is open-ended, having an open top located in the vicinity of the cup's open top end and an open bore which extends from its open top end and terminates at the cup's bottom end in the recessed portion so as to form an opening therein and a second threading tunnel. This second tubular member, whose threading tunnel preferably lies essentially on the cup's longitudinal axis, also may be configured so that its open bore is adapted to have a detonator seated therein. For example, it may have a circular bore that is stepped-down in diameter at a location approaching its open top end so as to produce a detonator-retaining cavity in the larger-diameter portion. This particular carrier is adapted to be used in a primer which can be initiated by a detonating cord or a detonator located in the preferably axial bore of the second tubular member, with a detonator's leg wires or LEDC threaded through the off-set first threading tunnel, and, when required, an explosive coupling element located in the recessed portion at the bottom end of the cup.

In a still further embodiment, when the second tubular member has an open bore extending from its open top end to the bottom end of the cup, such bore may be the bore of a first tubular portion of that member, which portion preferably lies essentially on the cup's longitudinal axis adjacent the first tubular member. In this embodiment, the second tubular member has a second tubular portion which is shorter than the first and has a closed end located inside the cup, the first and second tubular portions having adjacent, essentially circular bores which combine to form a unitary, essentially oval bore having an open end which terminates at the bottom end of the cup in the recessed portion so as to form an opening therein, the oval bore extending from the closed end of the second tubular portion to the bore's terminus at the cup's bottom end, and the essentially circular bore of the first tubular portion continuing beyond the second tubular portion's closed end as far as the first tubular portion's top end, the bore of the second tubular portion forming a detonator-positioning cavity, or cap well, and the bore of the first tubular portion forming the second threading tunnel that intervenes between the detonator-positioning cavity and the first threading tunnel. With this carrier the primer can be initiated by a detonating cord threaded through the preferably axial bore of the first tubular portion, or a detonator seated in the detonator-positioning cavity formed by the bore of the second tubular portion. Detonator leg wires or LEDC are threaded through the off-set first threading tunnel, and, when required, an explosive coupling element is placed in the recessed portion at the bottom end of the cup.

In the embodiment wherein the second tubular member has two adjacent tubular portions, because both a cap well and an adjacent threading tunnel are formed in the merged bores of the two portions of the second tubular member over a part of its length, the cross-sectional configuration of the bore, in the cap-well section thereof, is essentially that of two merged circles, or an oval, while the remainder of this bore is essentially circular. In a more preferred embodiment of the invention, adapted for use particularly in situations in which it is advisable to enhance the reliability of the pick-up of the detonation by the primer explosive charge from a detonator in the cap well or a detonating cord in the bore of the first tubular portion of the second tubular member, the latter's bore contains a small tubular booster charge, most preferably a mass of cap-sensitive rubber-like extruded mixture of a high explosive such as pentaerythritol tetranitrate and an elastomeric binder. This booster charge can be a single tube of circular cross-section that is seated in the bore of the first tubular portion of the second tubular member, i.e., in the second threading tunnel, extending essentially as far as the bottom of the cap well adjacent thereto; or two circular tubes merged to produce an element having a figure 8 cross-section, seated in the portion of the bore which has the configuration of two merged circles. The opening in the single tube or in the tubular portion of the dual-tube element located in the second threading tunnel is sized to accommodate a detonating cord to be positioned therein; and the opening in the tubular portion of the dual-tube element located in the cap well is sized to accommodate a detonator to be positioned therein.

In the embodiment in which the detonator-positioning cavity is formed in the larger-diameter portion of the two-diameter circular bore of the second tubular member coaxial with the second threading tunnel, the above-described small tubular booster charge will be a single tube seated in the larger-diameter portion of the bore, the opening in the tubular charge preferably being sized to provide a close fit with a detonator or detonating cord to be placed therein.

A carrier which contains the tubular booster charge usually will include a means, located in the recessed portion of the cup, for retaining the tubular booster charge in the bore of the second tubular member. Preferably, this retaining means is an apertured plug having one or more surfaces in locked engagement with the cup, the aperture in the plug being in register with the bore of the second tubular member. In the embodiment wherein the cap well is adjacent the second threading tunnel, the plug preferably is dual-apertured, with the apertures in register with the merged circles of the tubular member's bore and large enough to permit the passage of a detonator therethrough and into the cap well, and the passage of a detonating cord therethrough for threading through the booster charge in the threading tunnel. The plug is slotted or notched to permit the explosive-containing plastic connecting block (explosive coupler) to fit substantially completely within the cup's recessed portion.

BRIEF DESCRIPTION OF THE DRAWING

In the accompanying drawing, which illustrates specific embodiments of a primer and carrier of the invention; a delay primer assembly including the primer and adapted for use in the delayed initiation of deck-loaded explosive charges by means of a single detonating cord downline; and primer assemblies with other initiating means.

DETAILED DESCRIPTION

The explosive primer of the invention, by virtue of its carrier design, is adapted to be assembled in various ways with electrical or nonelectrical initiation means for loading into boreholes in decked or continuous charges of relatively insensitive explosives. In the primer shown in FIGS. 1 through 8, the primer is to be initiated by a percussion-actuated delay detonator whose percussion-sensitive ignition charge is in initiating proximity to a coupling explosive charge, housed in a plastic connecting block that is held in a recess in the bottom of the carrier. The coupling explosive charge is positioned sufficiently close to a cord-threading tunnel in the primer as to be initiatable by the detonation of a low-energy detonating cord (LEDC) threaded therethrough. A number of such primers can be made to slide on a single LEDC downline for placement in decked explosive charges in a borehole.

Figure 9:
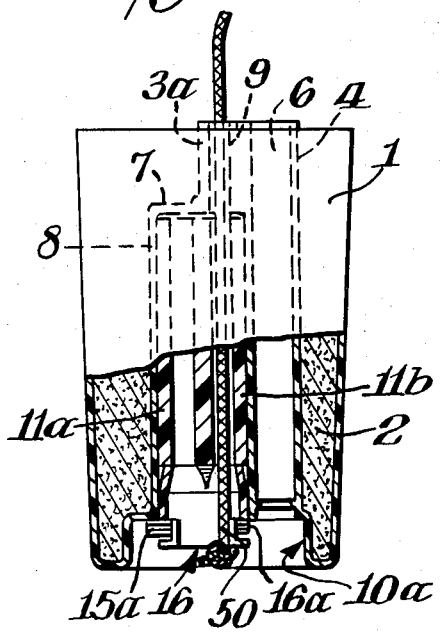
FIG. 9 is a front elevational view, partially broken away, of a primer of the invention assembled for initiation by an axial high-energy detonating cord.
Figure 10:
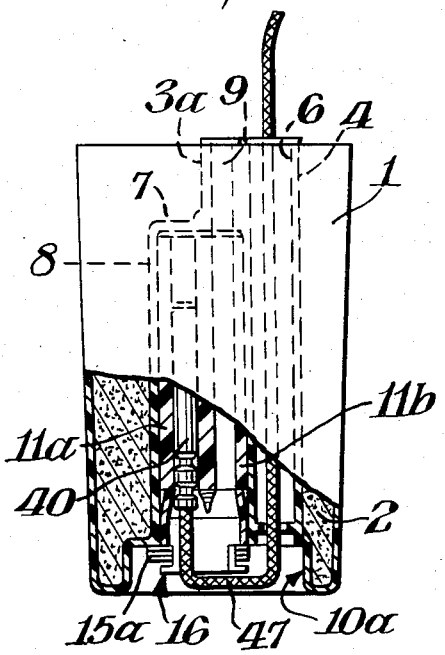
FIG. 10 is a front elevational view, partially broken away, of a primer of the invention assembled for initiation by a nonelectric delay detonator and associated low-energy detonating cord.

Alternative ways of initiating the primer are shown in FIGS. 9 and 10.

In the carrier shown in FIGS. 1 through 8, 1 is a cup, preferably plastic, e.g., a cup made of high-density polyethylene by injection molding techniques. Cup 1 has a closed bottom end 1*a* which, together with the cup's adjoining wall, forms a chamber for receiving primer explosive charge 2. Cup end 1*a* has a recessed portion 10 from which two adjacent tubular members 3 and 4 project into the cup parallel to the cup's longitudinal axis. Tubular member 4 has an open top end 4*a* located essentially at the open top end 1*b* of cup 1 in a transverse plane just beyond end 1*b*. The open bore of tubular member 4 extends from end 4*a* and terminates in recessed portion 10 so as to form an opening 6 therein. The bore of tubular member 4 is essentially circular throughout and sufficiently large that it forms a threading tunnel for threading a detonating cord or the leg wires of an electric detonator therethrough and for passing a detonator/cord or detonator/wire assembly therethrough in making a detonator hookup with the primer as will be described later.

Tubular member 3 has a tubular portion 3*b* which lies essentially on the longitudinal axis of cup 1 and has an open top end 3*c* also located essentially at the open top end 1*b* of cup 1 in a transverse plane just beyond end 1*b*. Tubular member 3 also has a second tubular portion 3*d* which is shorter than portion 3*b* and has a closed end 7 located inside cup 1, portions 3*b* and 3*d* having adjacent, essentially circular bores which combine to form a unitary, essentially oval bore having an open end which terminates in recessed portion 10 to form opening 5 therein. The oval bore extends from closed end 7 to opening 5. The essentially circular bore of portion 3*b* continues beyond end 7 as far as end 3*c*. The bore of portion 3*d* forms a cap well 8, with end 7 constituting the bottom of the well against which a detonator can be seated. In the case shown in FIG. 7, a booster tube 11*a*, described below, is seated against the bottom of the well. The bore of portion 3*b* of tubular member 3 forms another threading tunnel 9, also for threading a detonating cord or the leg wires of an electric detonator therethrough. The cross-sectional configuration of the bore of tubular member 3 is essentially that of two merged circles, or an oval, in the portion thereof extending as far as closed end 7. That is, the cross-section of the bore of tubular portion 3*d* forming cap well 8 is circular, and that of the adjacent tubular portion 3*b* forming threading tunnel 9 also is circular. Portion 3*b* has a smaller diameter in its section 3*a* that extends beyond portion 3*d*.

Figure 8:
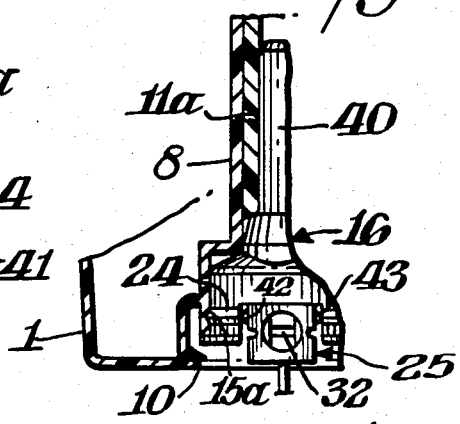
FIG. 8 is a fragmental left-side cross-sectional view of the carrier and detonator-engaging explosive coupler of FIG. 1 in assembled form.
Figure 4:
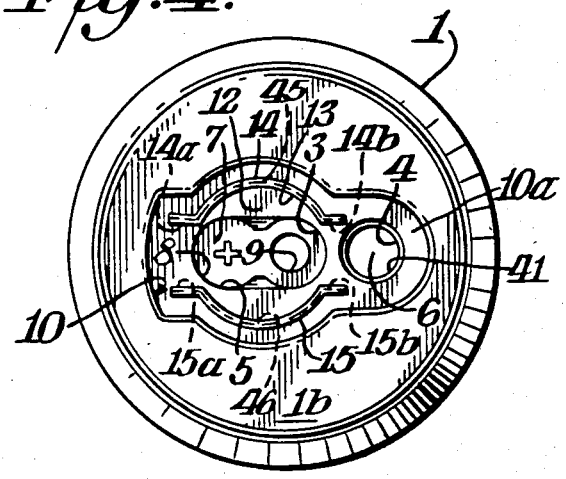
FIG. 4 is a bottom plan view of the cup portion of the carrier shown in FIG. 1 as seen from line 4—4 of FIG. 1.

Seated within the bore of tubular member 3, in the section thereof extending from recessed portion 10 to closed end 7, is booster charge 11, which consists of a mass of a cap-sensitive extruded mixture of pentaerythritol tetranitrate and an elastomeric binder having a FIG. 8 cross-section as formed from two merged tubes 11*a* and 11*b*. The openings in tubes 11*a* and 11*b* are in register with cap well 8 and threading tunnel 9, respectively. The outer diameters of the two merged tubes are the same. The inner diameter of tube 11*a* is large enough to allow a standard-size detonator shell to be placed therein. The inner diameter of tube 11*b* is the same as the inner diameter of section 3*a* of tubular portion 3*b*.

Recessed portion 10 in closed bottom end 1*a* of cup 1 is deeper at the site where tubular member 3 begins. That is, whereas tubular member 4 opens into surface 10*a* of recessed portion 10, the oval opening 5 formed by tubular member 3 is recessed further from end 1*a*, leaving, adjacent opening 5, a circular chamber 12 which forms a circular opening 13 in surface 10*a* adjacent the smaller circular opening 6. A pair of opposed arcuate lips 14, 15 projects from surface 10*a* on the periphery of circular opening 13, each end of each arcuate lip being bent away from circular opening 13 to form two pairs of opposed ribs 14*a*, 15*a* and 14*b*, 15*b* aligned in planes parallel to a plane containing the longitudinal axes of the bores of the threading tunnels. the facing surfaces of lips 14 and 15, including the facing surfaces of ribs 14*a*, 15*a* and 14*b*, 15*b*, are provided with linear grooves 45 and 46, respectively.

Figure 1:
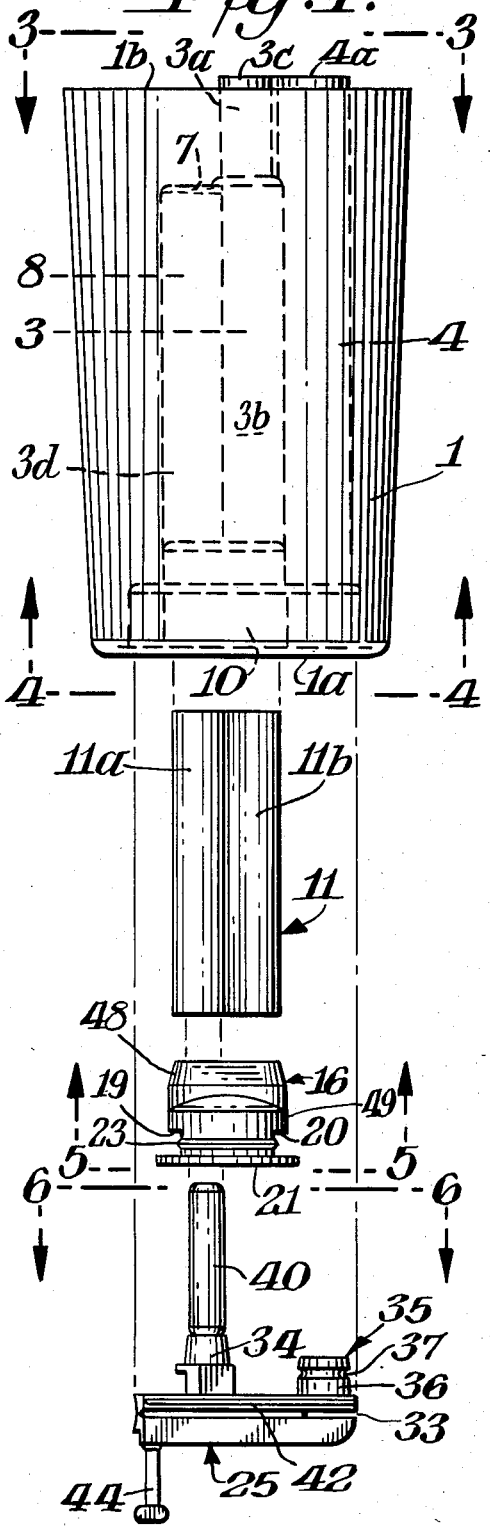
FIG. 1 is an exploded front elevational view of a carrier, including a cup, tubular booster charge, and booster-retaining plug, and a detonator-engaging explosive coupler engaged by the carrier.
Figure 2:
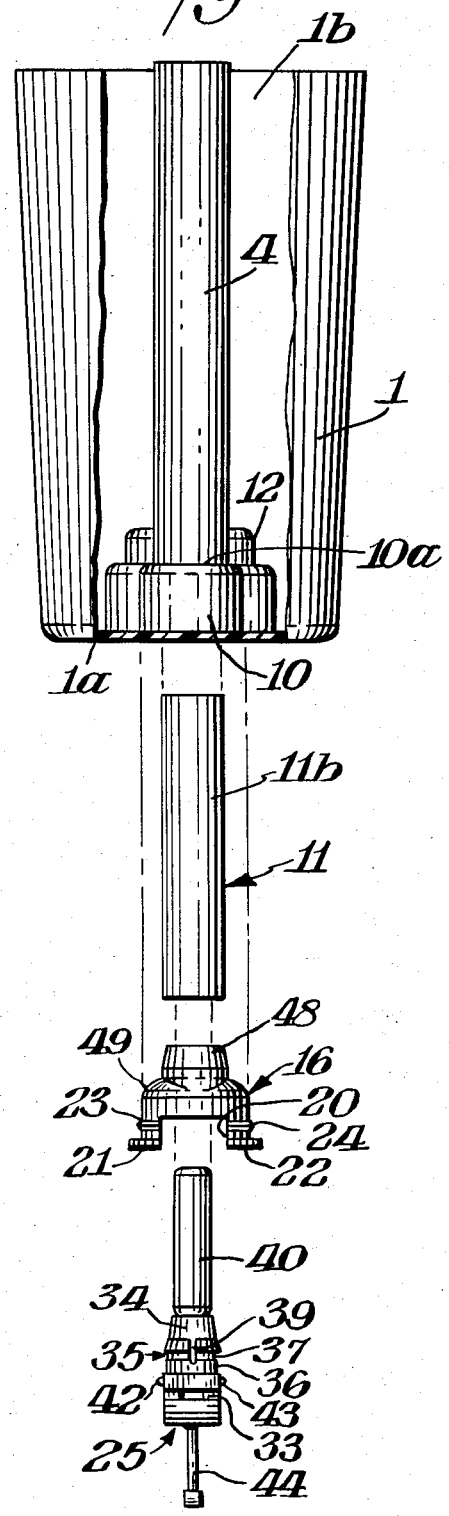
FIG. 2 is an exploded right-side elevational view, partially broken away, of the carrier/coupler assembly of FIG. 1.
Figure 3:
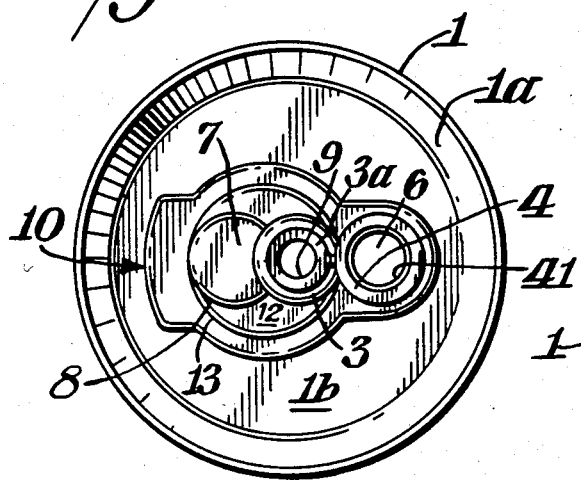
FIG. 3 is a top plan view of the cup portion of the carrier shown in FIG. 1 as seen from line 3—3 of FIG. 1.

The primer carrier shown in FIG. 1 includes means for retaining the FIG. 8 booster charge 11 in place in tubular member 3. The retaining means shown is a plug 16 having an oval-shaped inner portion 48 adapted to fit into the end of the oval bore of tubular member 3, and a hollow circular outer portion 49 adapted to fit into circular chamber 12. The inner portion contains two adjacent apertures 17, 18 of equal diameter and each large enough to permit the passage of a detonator therethrough. The outer portion 49 of plug 16 adjacent apertures 17, 18 contains two opposed notches 19 and 20 in its circular wall, leaving opposite arcuate wall sections 21 and 22. The outside surface of arcuate sections 21, 22 have arcuate ribs 23, 24, respectively, adapted to form a tongue-in-groove connection with the curved portions of linear grooves 45, 46 on lips 14, 15. When plug 16 is pushed into circular chamber 12 with apertures 17, 18 in register with the openings in tubes 11*a* and 11*b*, the pair of arcuate ribs 23, 24 on the plug engages the curved portions of the pair of linear grooves 45, 46 on the cup, leaving the sides of notch 19 aligned with opposed ribs 14*a*, 15*a*, and the sides of notch 20 aligned with opposed ribs 14*b*, 15*b*, formed on the ends of the arcuate lips which project from surface 10*a* of recessed portion 10. With plug 16 in place, the portions of linear grooves 45 and 46 on ribs 14*a* 14*b* and 15*a*, 15*b* remain exposed; and a chamber for receiving a block-like element in recessed position is formed by the sides of notches 19 and 20 of plug 16 and ribs 14*a* and 14*b* adjacent wall section 21, and ribs 15*a* and 15*b* adjacent wall section 22.

Figure 7:
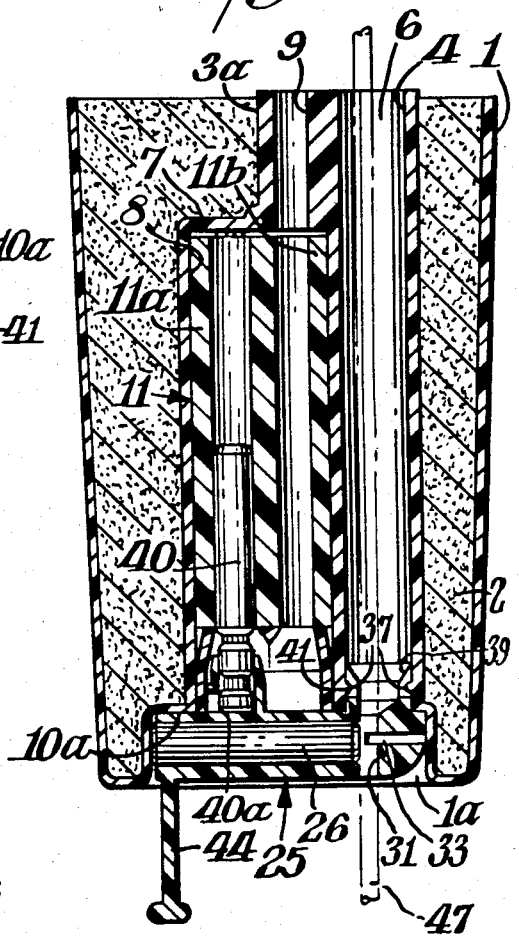
FIG. 7 is a longitudinal cross-sectional view of the carrier and detonator-engaging explosive coupler of FIG. 1 in assembled form, the carrier being filled with a primer explosive charge and threaded on a low-energy detonating cord downline.
Figure 5:
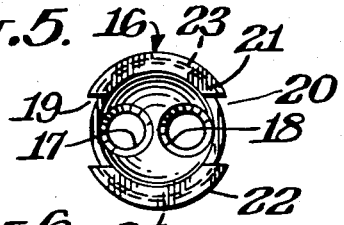
FIG. 5 is a bottom plan view of the plug portion of the carrier shown in FIG. 1 as seen from line 5—5 of FIG. 1.
Figure 6:
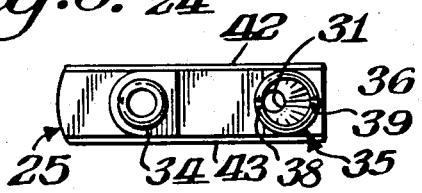
FIG. 6 is a top plan view of the detonator-engaging explosive coupler shown in FIG. 1 as seen from line 6—6 of FIG. 1.

In the primer shown in FIG. 7, the above-described carrier supports an explosive charge 2, typically a cast explosive of the kind commonly used in high-energy primers, e.g., the primer explosive described in U.S. Pat. No. 4,343,663, the disclosure of which is incorporated herein by reference. In the latter case, a PETN-sensitized water-in-oil emulsion in which the discontinuous phase is an aqueous solution of an inorganic oxidizing salt and the continuous phase is a liquid crosslinkable resin formulation is poured into cup 1 so that it fills the space surrounding tubular members 3 and 4. Thereafter the continuous phase hardens as a result of a crosslinking reaction therein.

Figure 7A:
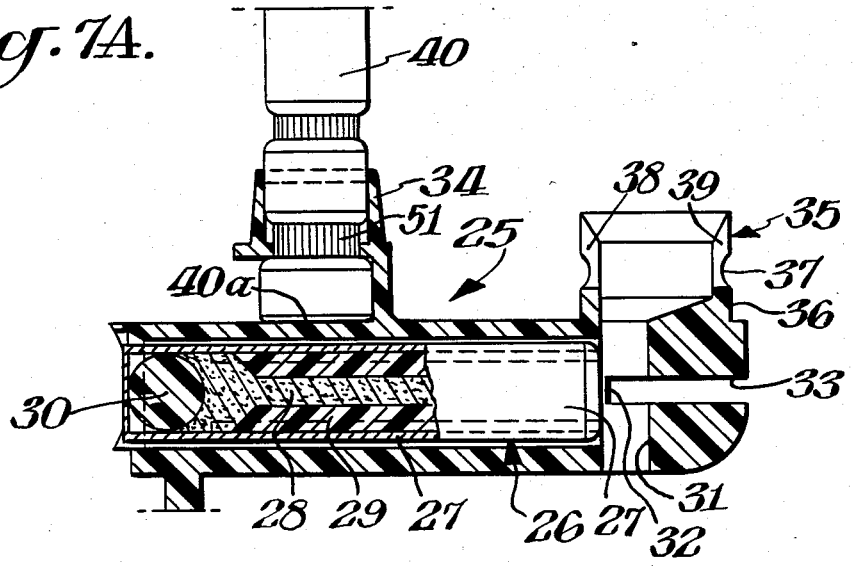
FIG. 7A is an enlarged view of the explosive coupler shown in FIG. 7.

The primer carrier of the invention includes means, in recessed portion 10, for engaging an explosive-containing plastic connecting block for explosively coupling a low-energy detonating cord adapted to be threaded through threading tunnel 4 to a detonator which is to be placed in cap well 8. An explosive-containing connecting block, or explosive coupler, of this type is described in copending U.S. patent application Ser. No. 714,505, filed Mar. 25, 1985, by M. E. Yunan. The carrier's ability to engage the explosive coupler in recessed portion 10 is important inasmuch as this feature allows the primer to be used in the delay priming of decked explosive charges by a single low-energy detonating cord downline 47, the primer being initiated by a delay detonator 40 (in cap well 8) which is operatively joined to the downline (in threading tunnel 4) via the explosive coupler. In the coupler shown in FIGS. 1, 2, 6, 7, 7A, and 8, the connecting block, denoted generally by the numeral 25, is a largely rigid plastic member having a generally tubular body. An explosive coupling element 26 is seated within the bore of the tubular body. This element is the same as element 12 shown in FIG. 1 of the above-mentioned copending application Ser. No. 714,505, the disclosure of which is incorporated herein by reference. As is shown in FIG. 7A herein, this explosive coupling element consists of a shell 27, e.g., made of metal, integrally closed at one end and containing a coupling charge 28 of shock-sensitive detonating explosive, e.g., lead azide powder. Shell 27 contains a plastic lining tube 29 ending short of its integrally closed end and bevelled at its edges to faciliate the flow of explosive powder during the loading of the shell. The open end of shell 27 is sealed with a spherical plastic plug 30. The bore of tube 29, and the space between (a) the end of tube 29 and the integrally closed end of shell 27, and (b) the other end of tube 29 and plug 30, contain explosive powder 28.

As is shown in FIG. 7, explosive coupling element 26 is seated in the bore of block 25. This bore is partially closed by a pair of stop means comprised of flat and tapered areas at the end of the bore. Located adjacent the stop means or bore closure is cord-threading aperture 31, which runs perpendicular to the bore and is sized to accommodate the low-energy detonating cord. An opening or slot 32 is formed by the stop means and aperture 31, owing to slot 33 in the end wall of block 25. Thus, when coupler shell 27 is pushed into the bore and comes to rest against the stop means, its coined-bottom end faces aperture 31 through the opening 32 in the stop means.

Projecting from the same side of the block's tubular body are a detonator-engaging means 34 and a cup-engaging fitting 35, spaced apart to the degree that when the block is positioned over the abovedescribed block-receiving chamber, a detonator 40 engaged by the block is in register with cap well 8, and fitting 35 is in register with threading tunnel 4. Fitting 35 is a circular short hollow tube 36 into which cord-threading aperture 31 opens. Tube 36 has a circular groove 37 on its outer periphery, with a pair of diametrically opposed longitudinal slits 38, 39 running through its wall and intersecting groove 37. Detonator-engaging means 34 is a tubular fitting which is sufficiently yieldable to enable the actuation end of detonator 40 to be forced into its bore with the detonator's percussion-actuated end 40*a* abutting the wall of block 25. Fitting 34 securely grips crimp 51 on the detonator. A portion of the wall of fitting 34 is open to permit direct viewing of the detonator end to assure its proper contact with the block. With the detonator in position, coupling charge 28 is in initiating proximity to the percussion-sensitive ignition charge of detonator 40.

When delay detonator 40 is engaged by explosive-containing connecting block 25, the primer (i.e., the explosive-filled carrier) is armed by positioning the block-detonator assembly in recess 10. Block 25 is locked into place by the tongue-in-groove connection between groove 37 on fitting 35 and a circular rib 41 in threading tunnel 4 near opening 6; and between ribs 42, 43 on the sides of block 25 and the exposed portions of linear grooves 45 and 46, respectively, on ribs 14*a*, 14*b* and 15*a*, 15*b* in the recessed portion of the cup. Detonator 40 now finds itself seated within the opening in tube 11*a* of booster charge 11 in cap well 8. To complete the primer-initiating assembly, a length of low-energy detonating cord 47, e.g., the cord described in U.S. Pat. No. 4,232,606, is threaded through cord-threading aperture 31 in block 25 and the bore of tubular member 4. A single length of this cord may be threaded through a number of such a delay primer assemblies for initiating a decked cap-insensitive explosive, each deck containing a delay primer. Detonating cord 47 has a low enough explosive core loading, i.e., only up to about 2.0 grams per meter of cord length, that it does not directly initiate or disturb the cap-insensitive explosive charge to be primed or require heavy confinement or wide separation from the primer explosive 2, tubular booster charge 11, or detonator 40 to avoid initiating them directly, as is the case with heavier cords. At the same time, the side energy output of this detonating cord is sufficient to initiate the coupling explosive charge 28 adjacent thereto. A preferred cord is one described in U.S. Pat. No. 4,232,606, the disclosure of which is incorporated herein by reference. This cord has a solid core of a deformable bonded detonating explosive composition comprising a crystalline high explosive compound, preferably superfine pentaerythritol tetranitrate (PETN), admixed with a binding agent. The crystalline explosive loading of this cord should be at least about 0.1 gram per meter, a preferred loading being in the range of about from 0.2 to 1.0 gram per meter. With explosive core loadings at the upper end of the LEDC range, e.g., about 2.0 grams per meter or higher, suitable confinement may be provided, e.g., a polyethylene sheath at least 0.16 cm thick around the core of explosive, to prevent direct initiation of the primer or the explosive charge to be primed. Suitable confinement also may be provided in the primer itself, e.g., as a lining tube in threading tunnel 4. The cord described in U.S. Pat. No. 3,125,024 also can be used, e.g., in a granular PETN core loading of about 0.7 to 1.0 gram/meter.

LEDC in which a granular explosive core is confined in a metal tube also can be employed (U.S. Pat. No. 2,982,210).

When the low-energy detonating cord 47 is threaded through tunnel 4 adjacent the bottom of explosive-containing shell 26, and the cord is caused to detonate (e.g., by means of a No. 6 electric blasting cap having its end in coaxial abutment with an exposed end of the cord), the detonation is picked up by coupling charge 28, which boosts the energy level of the detonation and applies sufficient percussive force in a radial direction as to selectively initiate the percussion-sensitive charge in detonator 40. After the delay period provided by the delay charge used in the detonator, booster 11 and primer charge 2 detonate.

The explosive primer shown in FIG. 7, having the carrier shown in FIG. 1 with elements 1, 11, and 16 fitted together as described above and loaded with explosive primer charge 2, can easily be armed in the field by attachment of the coupler/detonator assembly shown in FIG. 1. The primer also can be disarmed by pulling on pull tab 44 to release the coupler/detonator assembly from the primer.

The primer carrier of the invention, while adapting the primer to be initiated by a nonelectric delay detonator in a decked system by means of a single low-energy detonating cord downline, also is useful with other methods of initiation. For example, the carrier shown in FIG. 1, consisting of cup 1, tubular booster charge 11, and plug 16, and filled with primer explosive charge 2, constitutes an explosive primer which can be initiated, as is shown in FIG. 9, by means of a high-energy detonating cord 50, e.g., an 11 g/m cord, threaded through tunnel 9, and passing through tube **11*b* therein. The end of cord 50 is knotted so as to permit the primer to be lowered into a borehole by means of the cord. Cord tunnel 9 lies on the axis of cup 1**, a feature which is advantageous because the better balance that it affords help to avoid the hang-up problems which can occur when a primer strung on the end of a long lowering cord is moved through a borehole.

FIG. 10 shows a primer of the invention, assembled with a non-electric delay initiating means in which a downline low-energy detonating cord is used to initiate one primer only (in contrast to the assembly shown in FIG. 7). In the FIG. 10 assembly, detonator 40 is a nonelectric delay detonator, e.g., a percussion-actuated detonator, actuated by means of a low-energy detonating cord. A detonator of this type is described in U.S. Pat. No. 4,429,632. A cord/detonator assembly such as that described in U.S. Pat. No. 4,426,933, issued Jan. 24, 1984, to M. E. Yunan, may be employed, for example. In this assembly, a detonator closed at its actuation end by a shell having a percussion-sensitive charge supported adjacent its inside surface, can have a looped length of LEDC held adjacent the shell's outside end surface, e.g., by being threaded through an M-shaped loop-like projection diametrically disposed beyond the detonator's actuation end as part of a sleeve attachment. Looping of the LEDC in this manner places a pair of LEDC segments adjacent the detonator's actuation end, thereby assuring reliable actuation by means of the side-output of the low-energy cord. The cord/detonator assembly is threaded, detonator first, through the threading tunnel in tubular member 4, and, from there, detonator 40 is seated in tube **11*a* of booster charge 11 in cap well 8**.

The primer explosive 2 used in the primer of this invention can be any of the commonly used primer compositions such as cast pentolite or the explosive described in the aforementioed U.S. Pat. No. 4,343,663. The presence of tubular booster charge 11 in the bore of tubular member 3 in the carrier assures the reliability of the pick-up of the detonation by the primer explosive charge in cup 1 from a detonator in cap well 8 for from a detonating cord in threading tunnel 9, a feature which is useful with less-sensitive primer explosives. However, regardless of the primer explosive present, booster charge 11 may be preferred to assure the reliability of pick-up through the wall of tubular member 3 that is present between primer explosive 2 and detonator 40 or detonating cord 50. Preferably, a wall of plastic between primer explosive 2 and detonator 40 or detonating cord 50 should be no greater than about 3 millimeters.

When tubular booster charge 11 constitutes a part of the carrier, it can be a single tube seated in threading tunnel 9, or two merged tubes as is shown in FIG. 1. The single-tube booster will assure the pick-up of the detonation from detonating cord 50 in tunnel 9, and may also assist in the initiation of explosive 2 by means of detonator 40 in cap well 8. However, the dual-tube booster is preferred for initiation by a detonator inasmuch as, in this embodiment, the entire periphery of the detonator is surrounded by booster charge 11. When primer explosive 2 is to be initiated by downline cord 50, it is preferred that the opening in the single booster tube seated in threading tunnel 9, or in tube **11*b* of the dual-tube booster be sized to accommodate cord 50 with substantially no standoff space between the wall of tube 11*b* and cord 50. Thus, an opening sized to fit an 8.5–11 g/m cord preferably should be reduced if a 5–6 g/m cord is to be used. The necessity of providing booster charges having openings of different diameters, however, may be overcome by making charge 11 out of a more sensitive explosive, with which a standoff space between cord 50 and the wall of tube 11*b*** would be inconsequential.

Tubular booster charge 11 is a cap-sensitive rubber-like extruded mixture of a finely divided crystalline high explosive compound and binding agent, which can be a natural or synthetic organic polymer, e.g., the soluble nitrocellulose described in U.S. Pat. No. 2,992,087, or the mixture of an organic rubber and a thermoplastic terpene hydrocarbon resin described in U.S. Pat. No. 2,999,743. The crystalline high explosive compound can be an organic polynitrate such as PETN or mannitol hexanitrate, or polynitramine such as cyclotrimethylenetrinitramine (RDX) or cyclotetramethylenetetranitramine (HMX). PETN is the most readily available of these compounds and is satisfactory for use under conditions most commonly encountered in blasting, and for these reasons is the preferred crystalline high explosive in the bonded explosive. The crystalline high explosive content can vary, e.g., from about 50 percent to about 90 percent by weight of the extruded mixture. Preferably, it is at least about 70 percent by weight.

We claim:

1. A carrier for supporting a primer explosive charge in operative relationship to an initiating means therefor, said carrier comprising a cup having (a) an open top end and a closed bottom end, said bottom end being provided with a recessed portion;

(b) first and second tubular members projecting into said cup from said recessed portion on axes substantially parallel to said cup's longitudinal axis, (1) the first of said tubular members having an open top end located in the vicinity of said cup's open top end and an open bore which extends from said first tubular member's top end and terminates at the bottom end of said cup in said recessed portion so as to form an opening therein and a first threading tunnel in said cup, and (2) the second of said tubular members having (A) a closed end located inside said cup and a bore which extends from said closed end and terminates at the bottom end of said cup in said recessed portion so as to form an opening therein and a detonator-positioning cavity in said cup, or (B) an open top end located in the vicinity of said cup's open top end and an open bore which extends from said second tubular member's top end and terminates at the bottom end of said cup in said recessed portion so as to form an opening therein and a second threading tunnel or a detonator-positioning cavity in said cup; and (c) means in said recessed portion for engaging an explosive-containing plastic connecting block.

2. A carrier of claim 1 wherein said second tubular member lies essentially on the longitudinal axis of said cup, and said first tubular member has a closed end located inside said cup and a bore which forms a detonator-positioning cavity.

3. A carrier of claim 1 wherein said block-engaging means is a grooved or ribbed surface.

4. An explosive primer comprising the carrier of claim 1 and a primer explosive charge within said cup surrounding said tubular members.

5. A carrier of claim 1 wherein said second tubular member has an open top end and a bore which forms a second threading tunnel, said second tubular member being configured so that its bore is adapted also to form a detonator-positioning cavity.

6. A carrier of claim 5 wherein said second tubular member has a circular bore that is stepped-down in diameter at a location approaching its open top end, whereby a coaxial detonator-positioning cavity is formed in said second threading tunnel in the larger-diameter portion of said second tubular member.

7. A carrier of claim 5 wherein said second tubular member lies essentially on the longitudinal axis of said cup adjacent said first tubular member.

8. A carrier of claim 1 wherein said first and second tubular portions of said second tubular member having adjacent, essentially circular bores which combine to form a unitary, essentially oval bore having an open end which terminates at the bottom end of said cup in said recessed portion so as to form an opening therein, said oval bore extending from the closed end of said second tubular portion to the bore's terminus at said cup's bottom end, and the essentially circular bore of said first tubular portion continuing beyond said second tubular portion's closed end as far as said first tubular portion's top end, the bore of said second tubular portion forming a detonator-positioning cavity.

9. A carrier of claim 8 wherein said first tubular portion of said second tubular member lies essentially on the longitudinal axis of said cup adjacent said first tubular member.

10. A carrier of claim 8 wherein a tubular booster explosive charge comprising a cap-sensitive rubber-like extruded mixture of a finely divided crystalline high explosive compound and a binding agent is seated in said second threading tunnel.

11. A carrier of claim 10 wherein said booster charge comprises two tubes of circular cross-section merged to produce an element having a figure 8 cross-section, one of said tubes being seated in the bore of said detonator-positioning cavity while the other is seated in said second threading tunnel adjacent thereto.

12. A carrier of claim 10 including means in said recessed portion for retaining said booster explosive charge in the bore of said second tubular member.

13. A carrier of claim 12 wherein said retaining means is a dual-apertured plug having a surface in locked engagement with a surface in said recessed portion, the apertures in said plug being in register with said second threading tunnel and said detonator-positioning cavity, and large enough to permit the passage of a detonator therethrough and into said detonator-positioning cavity, and the passage of a detonating cord therethrough for threading in said second threading tunnel.

14. A carrier of claim 13 wherein said plug is configured with a grooved and ribbed surface so as to permit said plastic connecting block to become engaged by a grooved or ribbed surface in said recessed portion in a manner such that said connecting block is located within said recessed portion.

* * * * *